United States Patent [19]

LeVere et al.

[11] 4,094,158

[45] June 13, 1978

[54] LOADING GATE FOR MINE ROOF BOLTER APPARATUS

[75] Inventors: Richard W. LeVere; Joseph M. Vocaturo, both of Trenton; James L. Finney, Cranbury, all of N.J.

[73] Assignee: The United States of America as represented by the Secretary of the Interior, Washington, D.C.

[21] Appl. No.: 801,269

[22] Filed: May 27, 1977

[51] Int. Cl.[2] ..... E21C 11/02

[52] U.S. Cl. ..... 61/63; 61/45 B; 49/199; 296/56

[58] Field of Search ..... 61/63, 45 B, 45 D; 49/199, 340; 296/56, 57 R, 146

[56] References Cited

U.S. PATENT DOCUMENTS

| | | | |
|---|---|---|---|
| 1,859,364 | 5/1932 | Haskell | 49/340 |
| 3,842,610 | 10/1974 | Willis et al. | 61/63 |
| 3,869,168 | 3/1975 | Matheson | 296/56 |

*Primary Examiner*—Jacob Shapiro

*Attorney, Agent, or Firm*—Thomas Zack; Donald A. Gardiner

[57] ABSTRACT

A loading gate for a mine roof bolter apparatus forms a protective canopy for mine working personnel when opened, and when closed, it seals an opening in the bolter containing manual controls and roof bolt storage cartridges. Access to the stored cartridges and controls by the personnel can only be made when the gate is open. The gate is operated by an over-center toggle joint driven by a hydraulic cylinder. As a fail-safe feature, once the gate has been fully opened, the over-center toggle joint maintains the gate open even upon failure of the hydraulic cylinder.

13 Claims, 7 Drawing Figures

LOADING GATE FOR MINE ROOF BOLTER APPARATUS

BACKGROUND OF THE INVENTION

The present invention relates generally to mine roof bolter apparatus, and more particularly, to a loading gate for such apparatus which functions both as a protective canopy for mine working personnel and as a mechanism for preventing access to loading cartridges and controls by unauthorized personnel. The invention also relates to protective canopies for mine passageways which are pivotable between a lower, folded down position, and an upper, protective position.

Danger to mine working personnel in underground passageways of a mine has been recognized since the inception of underground mining. The need to support the overhead ceiling or roof in the underground passageway in the mine has been determined to be essential in order to prevent failure or collapse of the roof. In order to reinforce the roof, a mine roof bolter apparatus is provided which drills openings in the roof at predetermined, spaced apart intervals and inserts elongated roof bolts into the openings. These bolts tend to secure together thin strata or bands of rock above the roof and prevent lateral shifting of the strata, as well as, in some instances, anchor the strata to more massive overlying rock.

The roof bolter apparatus typically is mounted to the mine roof floor on skids and extends upwardly to the mine roof at which the bolting operation takes place. A sidewall of the apparatus is equipped with an access opening through which are exposed the controls for operating the apparatus as well as cartridges for storing the bolts.

The roof bolter apparatus is periodically loaded by mine working personnel who load the storage cartridges through the access opening. During that time, however, the mine personnel are exposed to an unsupported mine roof ahead of the apparatus. In order to minimize the risk of injury to these personnel, present regulations require that personnel be protected at all times by a roof support, canopy or other device.

Accordingly, it is a general object of the invention to provide a protective canopy for mine working personnel.

Another object is to provide a protective canopy for mine personnel during loading of a roof bolter apparatus.

Still another object of the invention is to provide a mine roof bolter apparatus having a loading gate that functions as a canopy at the access opening for protecting mine personnel.

It is desirable to exercise control over the roof bolter apparatus whereby only preselected personnel have access to the loading cartridges as well as to the operating controls of the bolter. Accordingly, there exists a need for a loading gate that blocks the access opening but can be opened by authorized personnel who perform loading, unloading and control operations.

Another object is therefore to provide a new and improved mine roof bolter apparatus which permits access to the loading cartridges and operating controls only to authorized mine working personnel.

SUMMARY OF THE INVENTION

A loading gate pivotably mounted to a mine roof bolter apparatus functions as a protective canopy for mine working personnel with the gate open, and as a shield to prevent access to loading cartridges and operating controls with the gate closed. The gate is pivotably mounted to the roof bolter apparatus above the access opening through which the operating controls and cartridges in which roof bolts are stored are exposed. A mechanical linkage is provided between the gate and apparatus for opening and closing the gate under control of a conventional hydraulic cylinder. The mechanical linkage is in the form of an over-center toggle joint comprising first and second toggle arms pivotably mounted end-to-end. The free end of the first arm is pivotably attached to the gate, and the second arm is pivotably mounted to the frame of the bolter apparatus at a point intermediate opposite ends of the arm. The hydraulic cylinder is connected between the free end of the second arm and the frame of the mine roof bolter apparatus.

When the piston of the hydraulic cylinder is fully extended and the first and second toggle arms are folded, the gate is downwardly folded or closed. In order to open the gate, the piston is retracted, pivoting the second arm about its pivot point on the bolter frame so as to unfold or swing the gate upwardly as the first and second toggle arms approach axial alignment. The two toggle arms are pivotably connected to each other with a pin and transverse slot mechanism.

Upon initiation of the hydraulic cylinder compression stroke, the slot, which is shaped as a circular arc with its center at the frame-to-second arm pivot point, allows the second arm to move some distance before engaging the mating pin on the first arm. This permits a triangular shaped nose on the second arm to independently initiate the deployment of the canopy while simultaneously improving the operating attitude of the total linkage system by depending on the total linkage system only after having partially unfolded the links. This permits the use of an initially critically folded linkage system, which is, in general, more compact. As the gate swings open such that the arms become axial in terms of pin alignment, the linkage configuration assumes an unstable mode as a result of the slot. Further compression of the cylinder drives the linkage past the axial configuration, at which time instability results as the pin shifts to the other side of the slot in response to the continued loading and slight dropping of the canopy. The canopy is now locked in the up position with no need for cylinder pressure. Accordingly, even if hydraulic pressure fails, the gate in the open, or protective, position is supported by the toggle arms without any external source of power, providing a fail-safe function.

Other objects, advantages and features of the present invention will become readily apparent to those skilled in this art from the following detailed description wherein we have shown and described only the preferred embodiment of the invention, simply by way of illustration of the best mode contemplated by us of carrying out our invention. It is to be understood that the invention is capable of other and different embodiments, and its several details are capable of modification in various obvious respects, all without departing from the inventive concept. Accordingly, the drawings and description are to be regarded as illustrative in nature, and not as restrictive.

DETAILED DESCRIPTION OF A PREFERRED EMBODIMENT

Figure 1:
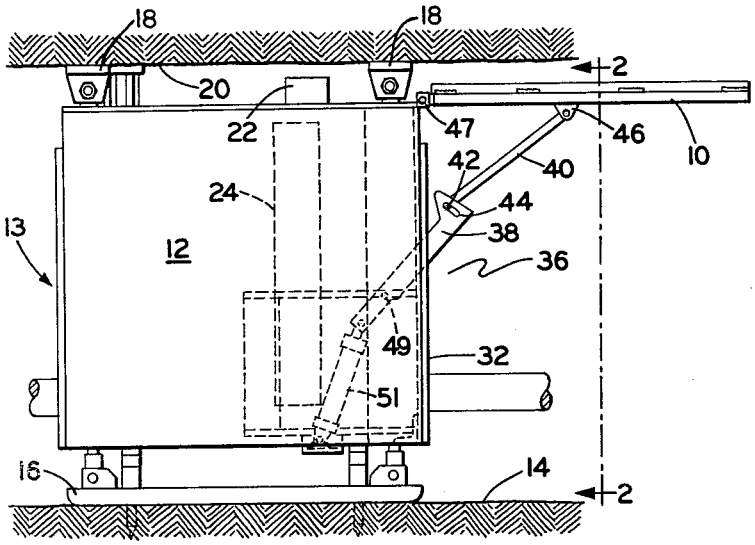
FIG. 1 is a side elevation view of a mine roof bolter apparatus having incorporated therewith a loading gate, in accordance with the present invention, in an open position.
Figure 2:
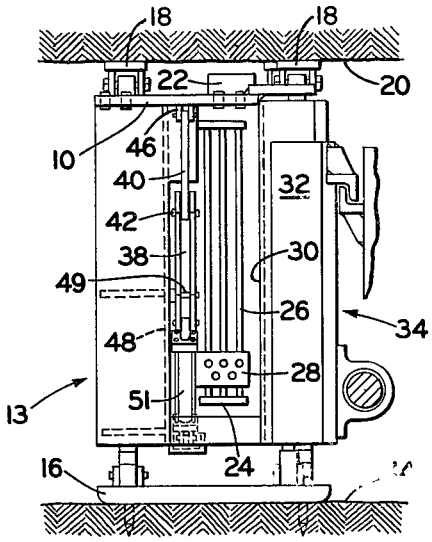
FIG. 2 is an end elevation view of the apparatus of FIG. 1 as viewed in the direction of arrows 2—2.

Referring now to the drawing, and particularly to FIG. 1 thereof, a loading gate 10 is incorporated with the frame 12 of a conventional mine roof bolter apparatus 13. The frame 12 is supported on the mine floor 14 by a conventional foot pad or skid 16 and is likewise provided with mine roof engaging devices or jack pads 18 which operatively engage the mine roof 20. In this manner, the bolter 13 is adequately supported with respect to the mine floor 14 and mine roof 20 so as to facilitate the performance of a mine roof bolting operation by means of at least one cartridge 24 for storing a plurality of roof bolts (see FIG. 2). The cartridge 24 and bolts 26 along with a conventional control panel 28 for manually controlling operation of the bolter 13 are contained in an access opening 30 formed in end wall 32 of the bolter 13. A conventional draft structure generally indicated at 34 is provided in conjunction with the apparatus 13 in order to facilitate transportation of the apparatus within the mine galley passageway.

Figure 3:
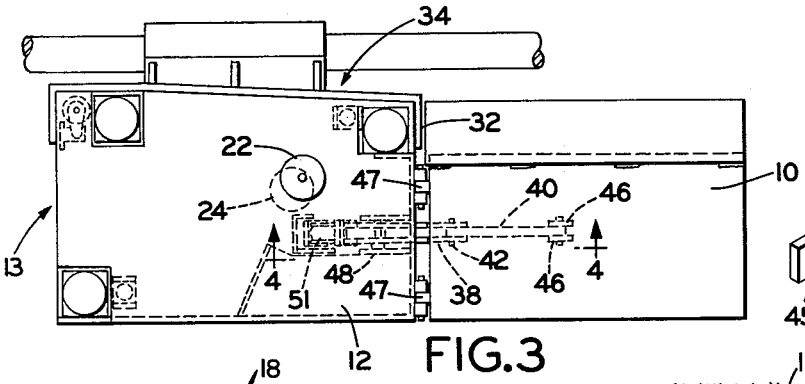
FIG. 3 is a plan view of the apparatus of FIG. 1.
Figure 5:
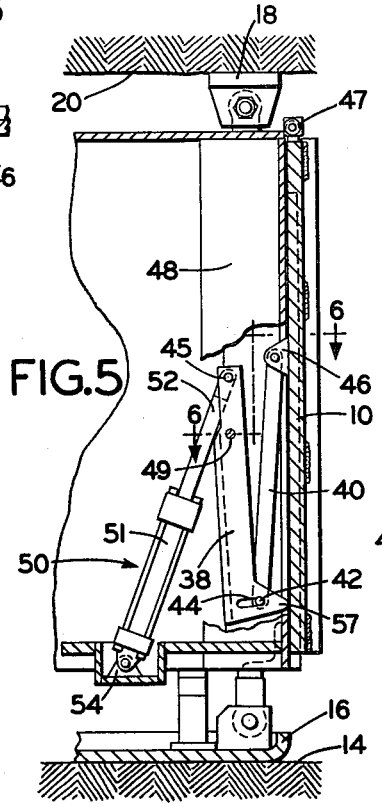
FIG. 5 is a partial side elevation view of the apparatus of FIG. 4 with the loading gate fully closed.
Figure 6:
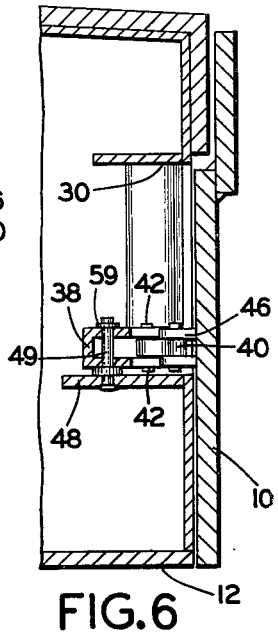
FIG. 6 is a cross sectional view of the apparatus taken along the line 6—6 in FIG. 5.

In accordance with the present invention, gate 10 is pivoted between the fully open position (FIG. 1) whereby the gate functions as a canopy for protecting personnel working adjacent access opening 30 from falling rocks and debris, and the fully closed position (FIG. 5) whereby the access opening 30 is sealed by the gate. Pivotably coupled between the gate 10 and frame 12 is an over-center toggle joint indicated generally at 36 which is operated by a conventional hydraulic cylinder 50. Toggle joint 36 comprises a first toggle arm pivotally coupled in end-to-end relationship to a second toggle arm 38. Referring to FIG. 6, one end of the arm 40 has integrally formed thereon a pair of opposed pins 42 that slidingly fit into transverse, slightly curved slots 44 formed in the second arm 38. The opposite end of the first arm 40 is pivotally mounted to tabs 46 formed on gate 10 at approximately a central portion thereof as shown in FIG. 3. One end of the gate 10 is hinged to frame 12 at hinges 47 and the opposite end is free.

The second arm 38 is pivotally mounted to a flange 48 (FIG. 6) formed on bolter frame 12 at a pivot point located intermediate opposite ends of the arm.

The hydraulic cylinder 50 comprises a cylinder body 51 into which is located a piston (not shown) having an outwardly extending piston rod 52. The cylinder body 51 is pivotably mounted to the bolter frame 12 at tabs 54, and the rod 52 is pivotably mounted to the end of the second toggle arm 38.

Figure 7:
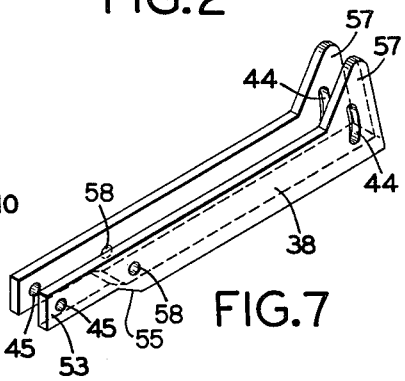
FIG. 7 is a perspective view of a linkage arm constituting a portion of an over-center toggle joint used for operating the gate.

Referring now to FIGS. 6 and 7, the second toggle arm 38 has a U-shaped, transverse cross section (FIG. 6) and contains apertures 45 formed at one end thereof, as well as apertures 58 formed in an intermediate portion of the arm, as shown in FIG. 7, and the transverse slots 44 formed in the opposite end. Each of the slots 44 is located in a transversely extended portion or nose 57 of the arm 38. The apertures 45 are formed in thin distal portions 53 defined by inclined shoulders 55. The shoulders 55 provide clearance for piston rod 52 when gate 10 is fully closed, as shown in FIG. 5. Pin 49 is welded to flange 48 and extends outwardly therefrom through the apertures 58 in arm 38. The arm 38 is retained to the pin 49 by end cap 59, but is free to pivot thereon. Further, pins 42 formed on first toggle arm 40 extend through the transverse slots 44 formed in the second arm 38. The diameters of pins 42 are less than the axial diameters of the slots 44 so that the pins are free to slide within the slots.

Figure 4:
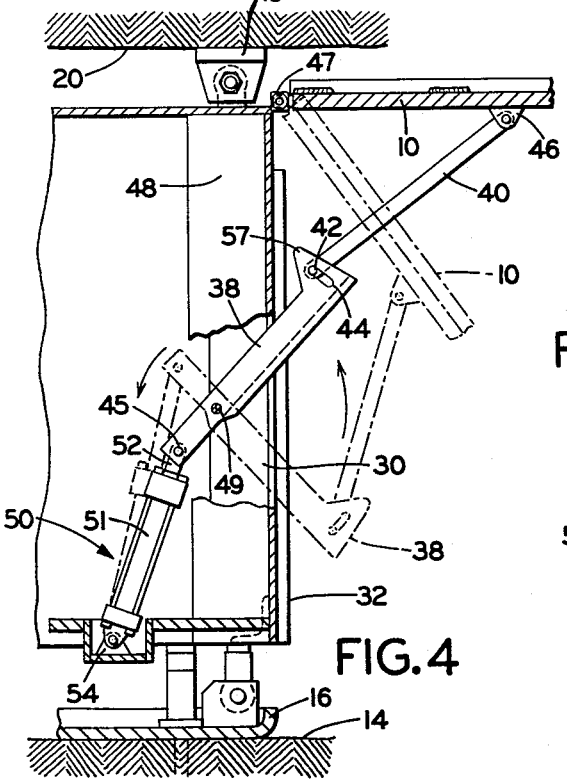
FIG. 4 is a partial side elevation view of the apparatus of FIG. 1 showing the operation of the loading gate.

In order to open gate 10, hydraulic cylinder 50 is operated to withdraw the piston arm 52 into cylinder body 51, as shown in FIG. 4. The second arm 38 is thus caused to pivot counterclockwise about pin 49, unfolding the toggle mechanism 36, with the arms 40 and 38 first becoming axially aligned, and subsequently going over center, as shown by the arrows in FIG. 4 whereupon pins 42 will slide to opposite sides of the slots. With piston arm 52 fully retracted within cylinder body 51 (see solid lines in FIG. 4), the arms 38 and 40 are locked in the over center position.

When the gate 10 is fully opened, as shown in FIGS. 1 and 4, it is apparent that any loading of the gate 10 tends to apply only longitudinal compressive force to the toggle arm 40, while a bending movement is applied to the arm 38. Furthermore, in the event of a failure of the hydraulic cylinder 50 with the gate 10 in the open position in which it functions as a canopy to shield mine personnel, the toggle mechanism 36 remains locked in that position, as shown in FIG. 1. As a result, the toggle mechanism 36 functions as a fail-safe mechanism supporting the gate 10 in the open position (canopy position).

When the gate 10 is fully closed, as shown in FIG. 5, access opening 30 in the bolter frame 12 is sealed by the gate, preventing personnel from loading or unloading the bolter 13 or operating the controls 28.

In this disclosure, there is shown and described only the preferred embodiment of the invention, but, as aforementioned, the invention is capable of use in other and different environments, and its details are capable of various modifications, all without departing from the inventive concept as expressed herein.

What is claimed is:

1. In combination with a mine roof bolter apparatus having an access opening in an end wall thereof for loading and unloading said apparatus, a door forming a protective canopy attached to said apparatus above said access opening for protective of personnel loading or unloading said apparatus; said door when in a closed position extending substantially the entire length of the access opening; and means engaging said mine roof and floor for fixedly mounting the mine roof bolter apparatus therebetween.

2. The combination of claim 1 wherein said canopy is pivotally mounted to said bolter apparatus, including means for moving said canopy between an upper protective position, and a lower position covering said access opening and preventing access thereto by mine personnel.

3. The combination of claim 2 wherein said bolter apparatus includes controls for operating said apparatus contained within said access opening, said controls being unaccessible to personnel when said canopy is in said lower position.

4. The combination of claim 2 including linkage means connected between said canopy and said bolter apparatus, said linkage means including first and second members pivoted to each other between said canopy and said bolter apparatus so as to form a toggle joint mechanism, said moving means including translating means connected to said linkage means and to said bolter apparatus.

5. The combination of claim 2, wherein said canopy moving means comprises a plurality of coupled, relatively movable arms interconnecting said canopy and said apparatus;

one of said arms having means disposed for slidable contact with a surface of a second arm; said moving means including means for moving said slidable contacting arm independently of the other arms of said plurality of movable arms to initiate movement of the canopy from one of said upper and lower positions to the other thereof.

6. An apparatus for protecting mine working personnel from falling objects in a mine galley, comprising:

a frame;

a loading gate pivotally mounted to said frame;

toggle joint means connected to said gate and said frame for pivoting said gate between an upper, protective position, and a lower, folded down position; and motor means operating said toggle joint means for moving said gate between the upper and lower positions thereof;

said toggle joint means including means for maintaining said gate in the upper position without the motor means operating.

7. The apparatus of claim 6 wherein said toggle joint means includes first and second toggle arms pivotally mounted end-to-end between said gate and said frame, said first arm being pivotally mounted to said gate, said second arm being pivotally mounted to said frame at a point on said second arm intermediate opposite ends thereof, a free end of said second arm being connected to said motor means.

8. The apparatus of claim 7 wherein said first and second toggle arms are pivotally mounted end-to-end with a pin and transverse slot mechanism, whereby said arms are pivoted into over center alignment to each other when said gate is in the upper position.

9. In combination with a roof bolter apparatus having an access opening for loading and unloading said apparatus;

a protective canopy attached to said apparatus above said access opening for protection of personnel loading or unloading said apparatus, said canopy being pivotally mounted to said bolter apparatus, including means for moving said canopy between an upper protective position, and a lower position covering said access opening and preventing access thereto by mine personnel; and said bolter apparatus including controls for operating said apparatus contained within said access opening, said controls being unaccessible to personnel when said canopy is in said lower position.

10. In combination with a roof bolter apparatus having an access opening for loading and unloading said apparatus;

a protective canopy attached to said apparatus above said access opening for protection of personnel loading or unloading said apparatus, said canopy being pivotally mounted to said bolter apparatus, including means for moving said canopy between an upper protective position, and a lower position covering said access opening and preventing access thereto by mine personnel; and including linkage means connected between said canopy and said bolter apparatus, said linkage means including first and second members pivoted to each other between said canopy and said bolter apparatus so as to form a toggle joint mechanism, said moving means including translating means connected to said linkage means and to said bolter apparatus.

11. The combination of claim 10 wherein said toggle joint mechanism is an over-center toggle joint, one end of said second member of said linkage means being pivotally mounted to an end of said first member, an opposite end of said second member being pivotally mounted to said translating means, said second member being mounted to said bolter apparatus at a point on said second member intermediate the ends thereof.

12. The combination of claim 11 wherein said translating means includes a hydraulic cylinder.

13. The combination of claim 11 wherein said first member of said linkage means includes a pin mounted in a transverse slot formed in said one of said second member, said pin sliding within said slot during movement of said linkage means so as to provide over center alignment between first and second linkage members when said canopy is in the upper position, said canopy thereby being maintained in said upper position independently of said translating means.

* * * * *